US008018417B2

(12) United States Patent
Jang et al.

(10) Patent No.: US 8,018,417 B2
(45) Date of Patent: Sep. 13, 2011

(54) COMMON VOLTAGE DRIVING CIRCUIT OF LIQUID CRYSTAL DISPLAY

(75) Inventors: Dae-Hyun Jang, Daejeon (KR); Hun Jeoung, Bokseong-Ri (KR)

(73) Assignee: LG Display Co. Ltd., Seoul (KR)

( * ) Notice: Subject to any disclaimer, the term of this patent is extended or adjusted under 35 U.S.C. 154(b) by 717 days.

(21) Appl. No.: 12/142,398

(22) Filed: Jun. 19, 2008

(65) Prior Publication Data

US 2008/0316160 A1 Dec. 25, 2008

(30) Foreign Application Priority Data

Jun. 20, 2007 (KR) ..... 10-2007-0060705
Apr. 16, 2008 (KR) ..... 10-2008-0035339

(51) Int. Cl.
*G09G 3/36* (2006.01)
*G09G 5/00* (2006.01)

(52) U.S. Cl. ..... 345/98; 345/204

(58) Field of Classification Search ..... 345/87, 345/90, 96, 98, 204, 209
See application file for complete search history.

(56) References Cited

U.S. PATENT DOCUMENTS

2005/0007164 A1* 1/2005 Callahan ..... 327/133
2005/0195149 A1* 9/2005 Ito ..... 345/98
2006/0125759 A1* 6/2006 An ..... 345/98
2006/0274015 A1* 12/2006 Endo et al. ..... 345/98

* cited by examiner

*Primary Examiner* — Kevin Nguyen
*Assistant Examiner* — Jonathan Boyd
(74) *Attorney, Agent, or Firm* — Brinks Hofer Gilson & Lione

(57) ABSTRACT

A common voltage driving circuit of a liquid crystal display, includes: a clock signal input unit that comprises a plurality of transistors and inputs first and second clock signals according to a gate output voltage; an output node voltage controller that comprises a plurality of transistors and condensers and changes voltages of positive and negative polarity output nodes by the first and second clock signals and first to third gate output voltages; an initialization voltage supply unit that comprises a plurality of transistors and supplies an initialization voltage of the output node voltage controller; and a common voltage output unit that comprises a plurality of transistors and a single condenser and prevents the voltages of the positive and negative polarity output nodes from being changed by using the condenser in alternately outputting higher and lower common voltages according to the voltages of the positive and negative polarity output nodes.

18 Claims, 3 Drawing Sheets

COMMON VOLTAGE DRIVING CIRCUIT OF LIQUID CRYSTAL DISPLAY

This application claims the benefit of Korean Patent Application Nos. 2007-0060705, filed on Jun. 20, 2007 and 2008-0035339, filed on Apr. 16, 2008, the entire content of which is hereby incorporated by reference for all purposes as if fully set forth herein.

BACKGROUND OF THE INVENTION

1. Field of the Invention

The present invention relates to a technique for supplying a common voltage of a liquid crystal display (LCD) and, more particularly, to a common voltage driving circuit of an LCD capable of preventing a common voltage from being floated in a liquid crystal panel.

2. Description of the Related Art

In line with the recent development of information technology (IT), the demands for flat panel display devices are rapidly increasing. An LCD is a typical flat panel display devices.

The LCD is a display device in which image information is individually provided to pixels arranged in a matrix form to control light transmittance of the pixels to thus display a desired image. For this purpose, the LCD includes a liquid crystal panel on which pixels, the minimum units for implementing an image, are arranged in a matrix form and a driving IC (Integrated Circuit) (driver) for driving the liquid crystal panel. In addition, the LCD includes a backlight unit that provides light, because the LCD does not emit itself.

In general, if the liquid crystal panel includes a common voltage driving circuit (drive IC), a positive polarity or negative polarity common voltage is applied to the liquid crystal panel via the common voltage driving circuit. In this case, the common voltage of a desired level (intended level) cannot be stably provided due to a parasitic capacitance or a leakage current present near the driving circuit or peripheral circuits.

For example, when a negative polarity common voltage is supplied to the liquid crystal panel via the common voltage driving circuit, voltage of an output node (Q-node) does not maintain its initial level as intended but gradually changes due to a parasitic capacitance or a leakage current as shown in FIG. 1.

That is, voltages of the positive and negative polarity output nodes (Q-node, $\overline{Q}$-Node) alternately maintain 'Low' level, but the voltages do not maintain its initial level (Ideal Case Q-node or Ideal Case $\overline{Q}$-Node) as intended but rise gradually.

This results in the occurrence of a common voltage floating phenomenon, causing a defective screen image as shown in FIG. 2.

Thus, the related art LCD having the common voltage driving circuit cannot appropriately cope with the variation of the lower or higher common voltage level, causing degradation of picture quality.

SUMMARY

A common voltage driving circuit of a liquid crystal display, includes: a clock signal input unit that inputs first and second clock signals according to a gate output voltage; an output node voltage controller that changes voltages of positive and negative polarity output nodes by the first and second clock signals and first to third gate output voltages; an initialization voltage supply unit that supplies an initialization voltage of the output node voltage controller; and a common voltage output unit that prevents the voltages of the positive and negative polarity output nodes from being changed by using a condenser in alternately outputting higher and lower common voltages according to the voltages of the positive and negative polarity output nodes.

The foregoing and other objects, features, aspects and advantages of the present invention will become more apparent from the following detailed description of the present invention when taken in conjunction with the accompanying drawings.

DETAILED DESCRIPTION OF THE INVENTION

Exemplary embodiments of the present invention will now be described in detail with reference to the accompanying drawings.

Figure 3:
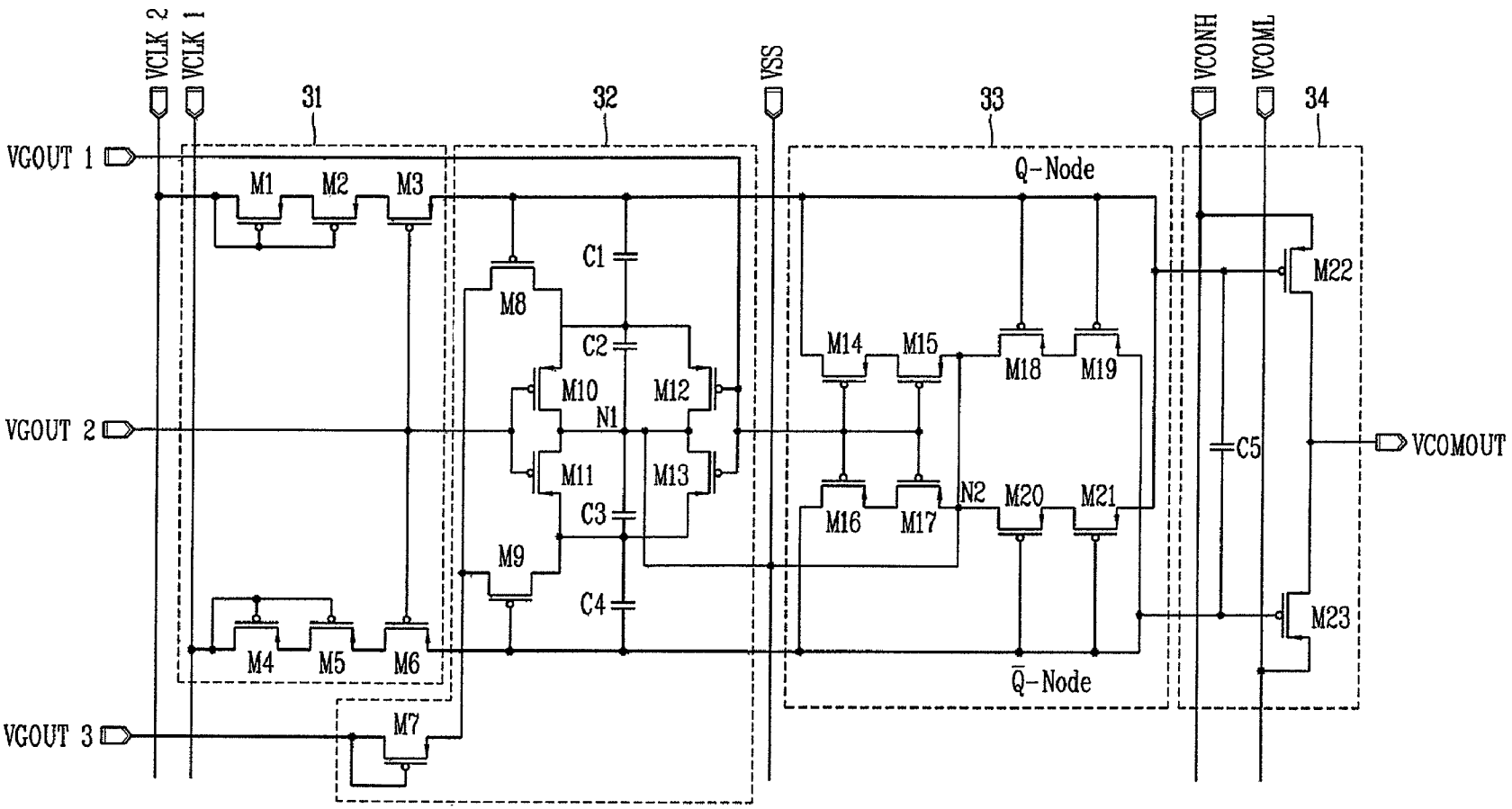
FIG. 3 is a circuit diagram of a common voltage driving circuit of a liquid crystal display (LCD) according to an embodiment of the present invention.

FIG. 3 is a circuit diagram of a common voltage driving circuit of a liquid crystal display (LCD) according to an embodiment of the present invention.

As shown in FIG. 3, a common voltage driving circuit includes: a clock signal input unit 31 including 1st to 6th MOS transistors M1 to M6 and inputting first and second clock signals VCLK1 and VCLK2 according to a gate output voltage; an output node voltage controller 32 including 7th to 13th MOS transistors M7-M13 and first to fourth condensers C1 to C4 and changing voltages of positive and negative polarity output nodes (Q-Node) ($\overline{Q}$-Node) by the first and second clock signals VCLK1 and VCLK2 and the first to third gate output voltages VGOUT1 to VGOUT3; an initialization voltage supply unit 33 including 14th to 21st MOS transistors M14 to M21 and supplying an initialization voltage of the output node voltage controller 32; and a common voltage output unit 34 including the 22th and 23th MOS transistors M22 and M23 and a condenser C5 and preventing voltages of the positive and negative polarity output nodes (Q-Node) ($\overline{Q}$-Node) from being changed from their initial levels by using the condenser C5 in alternately outputting an higher common voltage VCOMH or a lower common voltage VCOML according to the voltages of the positive and negative polarity output nodes (Q-Node) ($\overline{Q}$-Node).

In the clock signal input unit 31, a terminal of a second clock signal VCLK2 is connected to the positive polarity output node (Q-Node) sequentially via (or through) the diode type first and second MOS transistors M1, M2 and the third MOS transistor M3, and a terminal of a first clock signal VCLK1 is connected to the negative output node ($\overline{Q}$-Node) sequentially via the diode type fourth and fifth MOS transistors M4, M5 and the sixth MOS transistor M6. Also, a terminal of a second gate output voltage VGOUT2 is commonly connected to the gates of the third and sixth MOS transistors M3 and M6.

Here, regarding the diode type first and second MOS transistors M1 and M2 and the third MOS transistor (M3) that are connected in series between the terminal to which the second clock signal VCLK2 is inputted and the positive polarity output node (Q-Node), the terminal to which the second clock signal VCLK2 is inputted is connected with a drain of the diode type first MOS transistor M1, a source of the first MOS transistor M1 is connected with a drain of the second MOS transistor M2, and a source of the diode type second MOS transistor M2 is connected with a drain of the third MOS transistor. The source of the third MOS transistor M3 is connected with the positive polarity output node Q-Node. Gates of the diode type first and second MOS transistors M1 and M2 are connected with the terminal to which the second clock signal VCLK2 is inputted.

Regarding the diode type fourth and fifth MOS transistors M4 and M5 connected between the terminal to which the first clock signal VCLK1 is inputted and the negative polarity output node $\overline{Q}$-Node, and the sixth MOS transistor M6, the terminal to which the first clock signal VCLK1 is inputted is connected with a drain of the fourth MOS transistor M4, a source of the fourth MOS transistor M4 is connected with a drain of the diode type fifth MOS transistor M5, and a source of the diode type fifth MOS transistor M5 is connected with a drain of the sixth MOS transistor. A source of the sixth MOS transistor M6 is connected with the negative polarity output node $\overline{Q}$-Node. In addition, gates of the diode type fourth and fifth MOS transistors M4 and M5 are connected with the terminal to which the first clock signal VCLK1 is inputted.

In the output node voltage controller 32, a plurality of first to fourth condensers C1 to C4 are serially connected between a positive polarity output node (Q-Node) and a negative polarity output node ($\overline{Q}$-Node), a first common connection point (or node) of the first and second condensers C1 and C2, among the plurality of first to fourth condensers C1~C4 is commonly connected with the intermediate connection node N1, a common connection point of the second and third condensers C2 and C3, and power supply voltage terminal VSS to which a voltage is applied from the exterior electrically via the $10^{th}$ and $12^{th}$ MOS transistors M10, M12, respectively, and the first intermediate connection node (N1) is connected with a second common connection point of the third and fourth condensers C3 and C4 electrically via the $11^{th}$ and $13^{th}$ MOS transistors M11 and M13.

In addition, a first gate output voltage VGOUT1 is commonly connected with the gates of the $12^{th}$ and $13^{th}$ MOS transistors M12 and M13 which are connected in series to each other. A terminal to which a second gate output voltage VGOUT2 is inputted is connected with gates of the $10^{th}$ and $11^{th}$ MOS transistors M10 and M11 which are connected in series to each other. A terminal to which a third gate output voltage VGOUT3 is inputted is connected with the first common connection point of the first and second condensers C1 and C2 and the second common connection point of the third and fourth condensers C3 and C4 electrically via the diode type $7^{th}$ MOS transistor M7 and then the $8^{th}$ and $9^{th}$ MOS transistors M8 and M9. In this case, a gate of the diode type $7^{th}$ MOS transistor M7 is connected with the positive and negative polarity output nodes Q-Node and $\overline{Q}$-Node.

Regarding the $10^{th}$ and $11^{th}$ MOS transistors M10 and M11 and the $12^{th}$ and $13^{th}$ MOS transistors M12 and M13 which are connected in series between the first common connection point of the first and second condensers C1 and C2 and the second common connection point of the third and fourth condensers C3 and C4, sources of the $10^{th}$ and $12^{th}$ MOS transistors M10 and M12 are connected with the first common connection point, and sources of the $11^{th}$ and $13^{th}$ MOS transistors M11 and M13 are connected with the second common connection point. Gates of the $10^{th}$ and $11^{th}$ MOS transistors M10 and M11 are connected to each other so as to be connected with a terminal to which the second gate output voltage VGOUT2 is inputted, and drains of the $10^{th}$ and $11^{th}$ MOS transistors M10 and M11 are connected to each other so as to be connected with the first intermediate connection node N1. In addition, gates of the $12^{th}$ and $13^{th}$ MOS transistors M12 and M13 are connected to each other so as to be connected with the terminal to which the first gate output voltage VGOUT1 is inputted, and drains of the $12^{th}$ and $13^{th}$ MOS transistors M12 and M13 are connected to each other so as to be connected with the first intermediate connection node N1.

The drain and the gate of the diode type $7^{th}$ MOS transistor M7 are commonly connected with a terminal to which a third gate output voltage VGOUT3 is inputted, the source of the diode type $7^{th}$ MOS transistor M7 is commonly connected with the drains of the $8^{th}$ and $9^{th}$ MOS transistors M8 and M9, the source of the $8^{th}$ MOS transistor M9 is connected with the first common connection point, and the source of the $9^{th}$ MOS transistor M9 is connected with the second common connection point. The gate of the $8^{th}$ MOS transistor M8 is connected with the positive polarity output node Q-Node, and the gate of the $9^{th}$ MOS transistor M9 is connected with the negative polarity output node $\overline{Q}$-Node.

In the initialization voltage supply unit 33, the terminal to which the first gate output voltage VGOUT1 is inputted is commonly connected to the gates of the $14^{th}$ to $17^{th}$ MOS transistors M14 to M17, and the power source terminal VSS is commonly connected with the second intermediate connection node N2, a common connection point to which the sources of the $15^{th}$ to $17^{th}$ MOS transistors M15 and M17, among the $14^{th}$ to $17^{th}$ MOS transistors M14 to M17, are commonly connected. The second intermediate connection node M2 is connected with the positive and negative polarity output nodes Q-Node and $\overline{Q}$-Node via the $14^{th}$ and $15^{th}$ MOS transistors M14 and M15 and the $16^{th}$ and $17^{th}$ MOS transistors M16 and M17. The intermediate connection node N2 is connected with the positive and negative polarity output nodes Q-Node and $\overline{Q}$-Node via the $20^{th}$ and $21^{st}$ MOS transistors M20 and M21 and the $18^{th}$ and $19^{th}$ MOS transistors M18 and M19. The positive and negative polarity output nodes Q-Node and $\overline{Q}$-Node are connected with the gates of the $18^{th}$ and $19^{th}$ MOS transistors M18 and M19 and $20^{th}$ and $21^{st}$ MOS transistors M20 and M21.

In other words, between the positive and negative polarity output nodes Q-Node and $\overline{Q}$-Node, the $14^{th}$ and $16^{th}$ MOS transistors M14 and M15, and the $18^{th}$ and $19^{th}$ MOS transistors M18 and M19 are connected in series to each other, and the $16^{th}$ and $17^{th}$ MOS transistors M16 and M17 and the $20^{th}$ and $21^{st}$ MOS transistors M20 and M21 are connected in series to each other, respectively.

In this case, gates of the $14^{th}$ to $17^{th}$ MOS transistors M14 to M17 are commonly connected with the terminal to which the first gate output voltage VGOUT1 is inputted, gates of the $18^{th}$ and $19^{th}$ MOS transistors M18 and M19 and the drain of the $14^{th}$ MOS transistor M14 are connected with the positive polarity output node Q-Node, and the gates of the $20^{th}$ and $21^{st}$ MOS transistors M20 and M21 and the drain of the $16^{th}$ MOS transistor M16 are connected with the negative polarity $\overline{Q}$-Node. The second intermediate connection node N2, which is connected with the common connection point of the source of the $15^{th}$ MOS transistor M15 and the drain of the $18^{th}$ MOS transistor M18 which are connected in series to each other and with the common connection point of the source of the $17^{th}$ MOS transistor M17 and the drain of the $20^{th}$ MOS transistor M20 which are connected in series to each other, is connected with the power source terminal VSS.

In the common output unit 34, the positive and negative polarity output nodes (Q-Node, $\overline{Q}$-Node) are connected to the gates of the $22^{nd}$ and $23^{rd}$ MOS transistors M22, M23, a fifth condenser C5 is connected between gates of the $22^{nd}$ and $23^{rd}$ MOS transistors M22, M23, and terminals to which the lower common voltage VCOML and the higher common voltage VCOMH are inputted are commonly connected to the common voltage output terminal VCOMOUT via the $22^{nd}$ and $23^{rd}$ MOS transistors M22, M23 respectively.

Namely, the positive polarity output node Q-Node is connected with the gate of the $22^{nd}$ MOS transistor M22, and the negative polarity output node $\overline{Q}$-Node is connected with the gate of the $23^{rd}$ MOS transistor M23. In this case, the fifth condenser C5 is connected between the gate of the $22^{nd}$ MOS transistor M22 and the gate of the $23^{rd}$ MOS transistor M23. In addition, the terminal to which the upper common voltage VCOMH is inputted is connected with the source of the $22^{nd}$ MOS transistor M22, and the terminal to which the lower common voltage VCOML is inputted is connected with the source of the $23^{rd}$ MOS transistor M23. The drains of the $22^{nd}$ and $23^{rd}$ MOS transistors M22 and M23 are connected to each other to form an output terminal of the common voltage The operation of the present invention constructed as described above will now be described in detail with reference to FIGS. 4*a* and 4*b*.

At an initial state of a first frame, a terminal voltage VSS of 10V is transferred to the first intermediate connection node N1 of the first to fourth condensers C1 to C4 which are connected in series. The first intermediate connection node N1 is commonly connected with the common connection point of drains and sources of the $10^{th}$ and $11^{th}$ MOS transistors M10, M11 and the $12^{th}$ and $13^{th}$ MOS transistors M12, M13 which are connected in parallel after being serially connected.

Figure 4A:
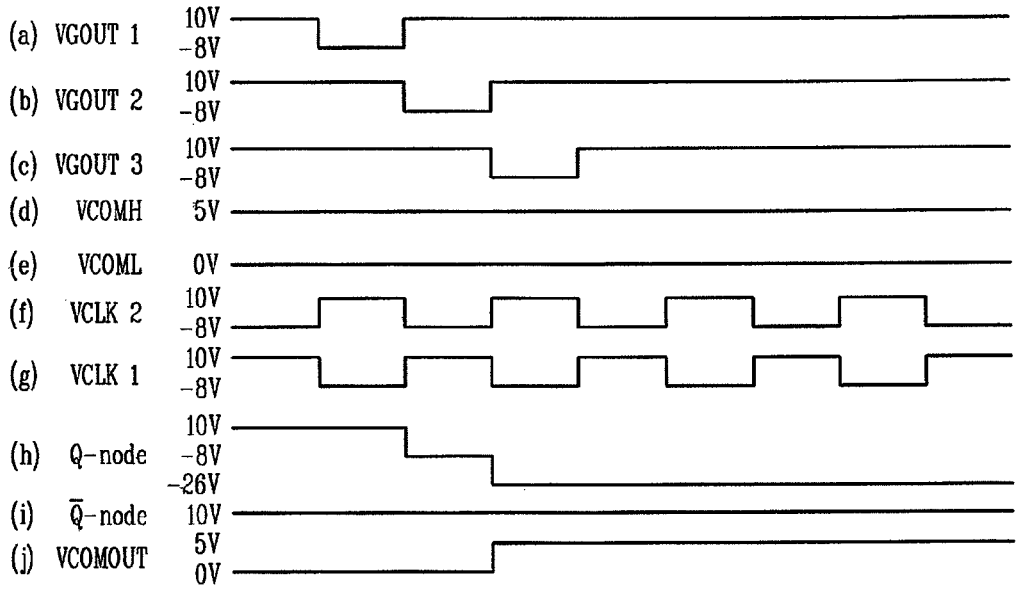
FIG. 4*a* shows waveforms of each part in FIG. 3 in a first frame.

In this state, a first gate output voltage VGOUT1 is inputted as a low level (−8V) like (a) as shown in FIG. 4*a* at the first frame, and accordingly, the $12^{th}$ to $17^{th}$ MOS transistors M12 to M17 are turned on. Then, both ends of the second condenser C2 are connected via the $12^{th}$ MOS transistor M12, and both ends of the third condenser C3 are connected via the $13^{th}$ MOS transistor M13.

In this case, the terminal voltage VSS is commonly transferred to the positive polarity output node (Q-Node) and one terminal of the first condenser C1 via the $14^{th}$ and $15^{th}$ MOS transistors M14, M15. In addition, the terminal voltage VSS is commonly transferred to the negative polarity output node ($\overline{Q}$-Node) and the other terminal of the fourth condenser C4 via the $16^{th}$ and $17^{th}$ MOS transistors M16 and M17.

Accordingly, when the first gate output voltage VGOUT1 is inputted as the low level (−8V) at the first frame, the respective intermediate connection points of the serially connected first to fourth condensers C1 to C4 and the two output nodes (Q-Node) ($\overline{Q}$-Node) are initialized as 10V.

Thereafter, when the second gate output voltage VGOUT2 is inputted as a low level (−8V) as indicated by (b) in FIG. 4*a*, and accordingly, the third MOS transistor M3 is turned on. Accordingly, a second clock signal VCLK2 of −8V as indicated by (f) in FIG. 4*a* is transferred to the positive polarity output node Q-Node sequentially via the diode type first and second MOS transistors M1 and M2 and the third MOS transistor M3.

Then, the voltage −8V, as indicated by (h) in FIG. 4*a*, outputted from the positive polarity output node is transferred to the gate of the $22^{nd}$ MOS transistor M22 of the output terminal, turning on the $22^{nd}$ MOS transistor M22.

At this time, the sixth MOS transistor M6 is also turned on by the second gate output voltage VGOUT2 of −8V, and because the first clock signal VCLK1 has 10V, the fourth and fifth MOS transistors M4 and M5 are not turned on, so the voltage level of the negative polarity output node $\overline{Q}$-Node is maintained at 10V as indicated by (i) in FIG. 4*a*.

Thereafter, the third gate output voltage VGOUT3 is inputted as a low level (−8V) as indicated by (c) in FIG. 4*a*, which is then transferred to the common connection point of the first and second condensers C1, C2 via the diode-type $7^{th}$ MOS transistor M7 and the $8^{th}$ MOS transistor M8. Accordingly, the voltage of the common connection point of the first and second condensers C1, C2 transitions from 10V to −8V Then, the voltage of the positive polarity output node Q-Node transitions from −8V to −26V by boost-rapping as indicated by (h) in FIG. 4*a*.

The $22^{nd}$ MOS transistor M22 is completely turned on by the output voltage (−26V) from the positive polarity output node (Q-Node).

Herein, the $22^{nd}$ MOS transistor M22 turned on completely by being boost-rapped to −26V from −8V performs a stable transition driving. That is, a stable pulse can not be provided to the liquid crystal panel since a change of rapid transition incurs noise phenomena.

Accordingly, the higher common voltage VCOMH as indicated by (d) in FIG. 4*a* is stably outputted to the common voltage output terminal VCOMOUT via the $22^{nd}$ MOS transistor M22. Namely, the higher common voltage VCOMH is outputted from the common voltage output terminal VCOMOUT. Herein, for example, the higher common voltage VCOMH may be 5V.

Figure 1:
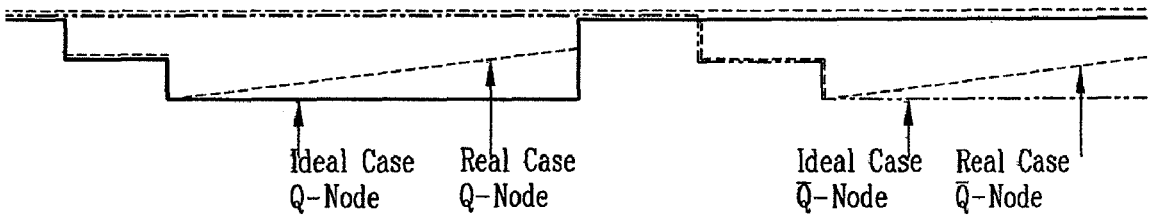
FIG. 1 RELATED ART
FIG. 1 is a waveform view of an output node voltage according to the related art.
Figure 2:
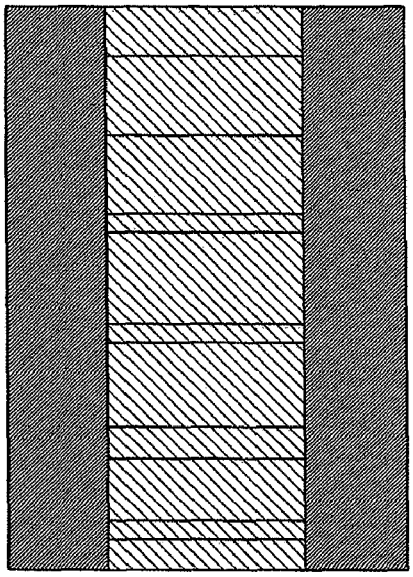
FIG. 2 RELATED ART
FIG. 2 is an exemplary view showing a defective screen image due to a common voltage flowing phenomenon according to the related art.

In this case, when the higher common voltage VCOMH is outputted through the above-described process, in general, the voltage at the positive polarity output node Q-Node is not maintained with its initial level as intended but gradually increased due to a peripheral parasitic capacitance or leakage current as shown in FIG. 1.

However, in the present invention, the voltage at the positive polarity output node Q-Node is not affected by a peripheral parasitic capacitance or a leakage current due to the presence of the condenser (C5) connected between the positive and negative polarity output nodes Q-Node and $\overline{Q}$-Node, so the voltage does not increase gradually. Thus, the higher common voltage VCOMH can be outputted in a stable form as shown in FIG. 4*a*.

Figure 4B:
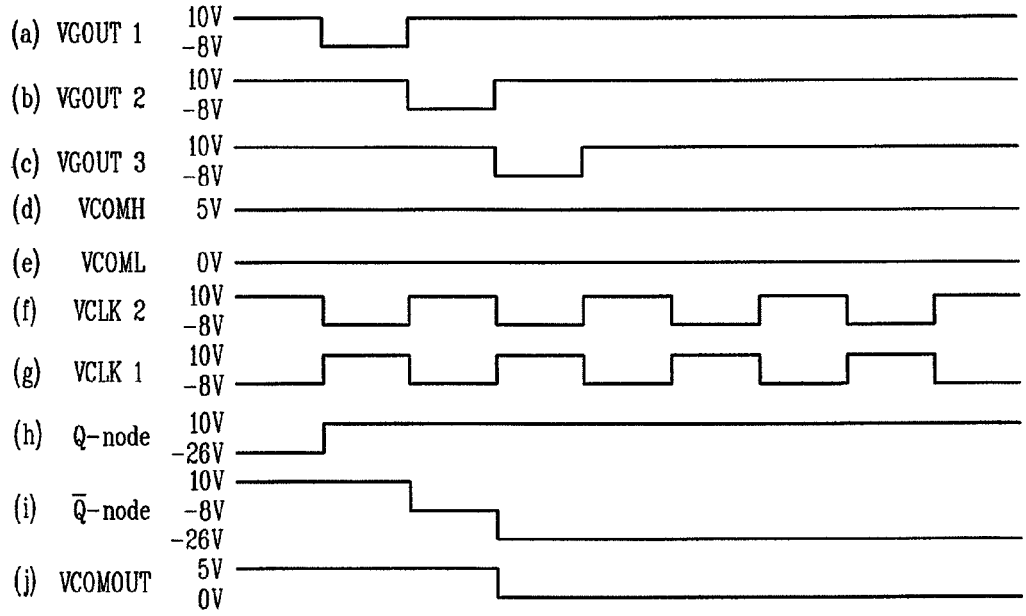
FIG. 4*b* shows waveforms of each part in FIG. 4 in a second frame.

When the second frame starts following the first frame, the first gate output voltage VGOUT1 is inputted with a low level (−8V) as indicated by (a) in FIG. 4*b*, and accordingly, the $12^{th}$ to $17^{th}$ MOS transistors M12 to M17 are turned on. Then, both ends of the second condenser C2 is connected through the $12^{th}$ MOS transistor M12 and both ends of the third condenser C3 is connected through the $13^{th}$ MOS transistor M13.

At this time, the terminal voltage VSS of 10V is commonly transferred to the positive polarity output node Q-Node and one terminal of the first condenser C1 via the $14^{th}$ and $15^{th}$ MOS transistors M15 and M14. Also, the terminal voltage VSS is commonly transferred to the negative polarity output node $\overline{Q}$-Node and the other terminal of the fourth condenser C4 via the MOS transistors M17 and M16.

Accordingly, when the first gate output voltage VGOUT1 is inputted with the low level (−8V) at the second frame, the voltage at the positive polarity output node (Q-Node) transitions from −26V to 10V as indicated by (h) in FIG. 4*b* and the voltage at the negative polarity output node $\overline{Q}$-Node is maintained at 10V as it is like that in the first frame.

Thereafter, the second gate output voltage VGOUT2 is inputted with the low level (−8V) as indicated by (b) in FIG.

4*b*, and accordingly, the third MOS transistor M3 is turned on. Then, the second clock signal VCLK2 of 10V as indicated by (f) in FIG. 4*b* is transferred to the positive polarity output node Q-Node sequentially through the diode-type first and second MOS transistors M1 and M2 and the third MOS transistor M3. In this case, because the voltage with the potential 10V has been already supplied to the positive polarity output node Q-Node through the above process, there is no change in the potential at the positive polarity output node Q-Node as indicated by (h) in FIG. 4*b*.

At this time, the sixth MOS transistor M6 is turned on by the second gate output voltage VGOUT2 of −8V. Accordingly, the first clock signal VCLK1 of −8V as indicated by (g) in FIG. 4*b* is transferred to the negative polarity output node $\overline{Q}$_Node via the diode-type fourth and fifth MOS transistors M4 and M5 and the sixth MOS transistor M6. Accordingly, the potential of the negative polarity output node $\overline{Q}$_Node transitions from 10V to −8V as indicated by (i) in FIG. 4*b*.

Finally, the voltage of −8V from the negative polarity output node $\overline{Q}$-Node is transferred to a gate of the 23$^{rd}$ MOS transistor M23 of the common voltage unit 34, and accordingly, the 23$^{rd}$ MOS transistor M23 begins to be turned on.

Thereafter, the third gate output voltage VGOUT3 is inputted with a low level (−8V) as indicated by (c) in FIG. 4*b*, which is then transferred to the common connection point of the third and fourth condensers C3 and C4 via the diode-type 7$^{th}$ MOS transistor M7 and the 9$^{th}$ MOS transistor M9. Accordingly, the voltage at the common connection point of the third and fourth condensers C3, C4 transitions from 10V to −8V Then, the voltage of the negative polarity output node $\overline{Q}$-Node transitions from −8V to −26V by boost-rapping as indicated by (i) in FIG. 4*b*.

The 23$^{rd}$ MOS transistor M23 is completely turned on by the output voltage −26V from the negative polarity output node $\overline{Q}$-Node.

Herein, the 23$^{rd}$ MOS transistor M23 turned on completely by being boost-rapped to −26V from −8V performs a stable transition driving. That is, a stable pulse can not be provided to the liquid crystal panel since a change of rapid transition incurs noise phenomena.

Accordingly, the lower common voltage VCOML as indicated by (e) in FIG. 4*b* is stably outputted to the common voltage output terminal VCOMOUT via the 23$^{rd}$ MOS transistor M23. Namely, the lower common voltage VCOML of zero level is outputted from the common voltage output terminal VCOMOUT. Herein, for example, the lower common voltage VCOML may be 0V.

In this case, when the lower common voltage VCOML is outputted through the above-described process, in general, the voltage at the negative polarity output node $\overline{Q}$_Node is not maintained with its initial level as intended but gradually increased due to a peripheral parasitic capacitance or leakage current, as shown in FIG. 1.

However, in the present invention, the voltage at the negative polarity output node $\overline{Q}$-Node is not affected by a peripheral parasitic capacitance or a leakage current due to the presence of the fifth condenser (C5) connected between the positive and negative polarity output nodes Q-Node and $\overline{Q}$-Node, so the voltage does not increase gradually.

Thus, the lower common voltage VCOML can be outputted in a stable form as shown in FIG. 4*b*.

Also, if the fifth condenser C5 in the common voltage output unit 34 is omitted, the present invention may replace the role of the fifth condenser C5 by increasing the capacity of first to fourth condensers C1 to C4 in the output node voltage controller 32.

However, in this case, since the capacity of the first to fourth condensers C1 to C4 should be increased by the amount of the fifth condenser C5, the overall capacity of the condenser is doubled compared with the use of the fifth condenser C5, which is, thus, ineffective.

In addition, since the first to fourth condensers C1 to C4 of the output node voltage controller 32 takes about 30% of the total circuitry area, the increase in the capacity of the first to fourth condensers C1 and C4 would require more installation space.

Experimental results show that, with the capacity of the fifth condenser C5 by more than 0.1 PF, the initial level of the voltages of the positive and negative output nodes Q-Node, $\overline{Q}$-Node are stably maintained.

As so far described, in the present invention, in supplying the common voltage to the liquid crystal panel via the common voltage driving circuit of the LCD, the condensers are installed at the output terminal to prevent the common voltage from being varied due to parasitic capacitance or a leakage current. Thus, the liquid crystal panel can be stably driven, and thus, degradation of picture quality can be prevented.

Also, installing the condenser at the common voltage output unit is more effective than installing the condenser at the output node voltage controller to stabilize the common voltage by using a smaller capacity of condenser.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A common voltage driving circuit of a liquid crystal display, comprising:

a clock signal output unit that includes a first to a sixth transistors M1-M6 and outputs first and second clock signals (VCLK1, VCLK2) input from the external system according to a control of at least the gate output voltage of first to third gate output voltages (VGOUT1, VGOUT2 and VGOUT3);

an output node voltage controller that comprises a seventh to a thirteenth transistors (M7-M13) and a first to a fourth condensers (C1-C4) and changes voltages of positive and negative polarity output nodes by the first and second clock signals and first to third gate output voltages (VGOUT1, VGOUT2 and VGOUT3);

an initialization voltage supply unit that comprises a fourteenth to a twenty first transistors (M14-M21) and supplies an initialization voltage of the output node voltage controller; and a common voltage output unit that comprises a twenty second and a twenty third transistors (M22, M23) and a fifth condenser (C5) and prevents the voltages of the positive and negative polarity output nodes from being changed by the fifth condenser (C5) when higher and lower common voltages are alternately output according to the voltages of the positive and negative polarity output nodes.

2. The driving circuit of claim 1, wherein the transistors are MOS transistors.

3. The driving circuit of claim 1, wherein, in the clock signal output unit, a terminal of a second clock signal (VCLK2) inputted from the exterior is commonly connected to the gates of the diode type first and second MOS transistors (M1, M2) and the drain of the diode type first MOS transistors (M1), the source of the diode type first MOS transistor (M1) and the drain of the diode type second MOS transistor (M2) are connected each other, the source of the diode type second MOS transistor (M2) and the drain of the third MOS transistor (M3) are connected each other, a terminal of a first clock signal (VCLK1) inputted from the exterior is commonly connected to the gates of the diode type fourth and fifth MOS transistors (M4, M5) and the drain of the diode type fourth MOS transistors (M4), the source of the diode type fourth MOS transistor (M4) and the drain of the diode type fifth MOS transistor (M5) are connected each other, the source of the diode type fifth MOS transistor (M5) and the drain of the sixth MOS transistor (M6) are connected each other, a terminal of a second gate output voltage (VGOUT2) from the exterior is commonly connected to the gates of the third and sixth MOS transistors (M3, M6), the source of the third MOS transistor is connected to the positive polarity output node (Q-Node), and the source of the sixth MOS transistor is connected to the negative output node ($\overline{Q}$-Node).

4. The driving circuit of claim 3, wherein the first and second clock signals (VCLK1, VCLK2) have mutually opposite phases.

5. The driving circuit of claim 3, wherein a 'Low' level of the first and second clock signals (VCLK1, VCLK2) is −8V, and a 'High' level of the first and second clock signals (VCLK1, VCLK2) is 10V.

6. The driving circuit of claim 1, wherein, in the output node voltage controller, the first to the fourth condensers (C1-C4) are serially connected between a positive polarity output node (Q-Node) and the negative polarity output node ($\overline{Q}$-Node), the common connection point of the first and second condensers (C1, C2) is connected to the sources of the $8^{th}$, $10^{th}$ and $12^{th}$ MOS transistors (M8, M10, M12), the common connection point of the third and fourth condensers (C3, C4) is connected to the sources of the $9^{th}$, $11^{th}$ and $13^{th}$ MOS transistors (M9, M11, M13), the first intermediate connection node (N1) between the second and third condensers (C2, C3) is commonly connected to the drains of the $10^{th}$ to $13^{th}$ MOS transistors (M10-M13) and a power supply terminal VSS, a terminal of a first gate output voltage (VGOUT1) is commonly connected to the gates of the $12^{th}$ and $13^{th}$ MOS transistors (M12, M13), a terminal of a second gate output voltage (VGOUT2) is commonly connected to the gates of the $10^{th}$, $11^{th}$ MOS transistors (M10, M11), a terminal of third gate output voltage (VGOUT3) is commonly connected to the gate and the drain of the diode type $7^{th}$ MOS transistors (M7), the drains of the $8^{th}$, $9^{th}$ MOS transistors (M8, M9) and the source of the diode type $7^{th}$ MOS transistors (M7) are connected each other, the gate of the $8^{th}$ MOS transistor (M8) is connected to the positive polarity output node (Q-Node), and the gate of the $9^{th}$ MOS transistor (M9) is connected to the negative polarity output node ($\overline{Q}$-Node).

7. The driving circuit of claim 1, wherein the gate output voltages (VGOUT1, VGOUT2, VGOUT3) sequentially transition from High level to Low level at every certain time period.

8. The driving circuit of claim 6, wherein the first to third gate output voltages (VGOUT1, VGOUT2, VGOUT3) are maintained as 10V or −8V.

9. The driving circuit of claim 1, wherein, in the initialization voltage supply unit, the terminal of gate output voltage (VGOUT1) inputted from the exterior is commonly connected to the gates of $14^{th}$ to $17^{th}$ MOS transistors (M14-M17), the positive polarity output node (Q-Node) is connected to the drain of $14^{th}$ MOS transistor (M14), the gates of the $18^{th}$ and $19^{th}$ MOS transistors (M18, M19), and the source of the $21^{st}$ MOS transistors (M21), the negative polarity output node ($\overline{Q}$-Node) is connected to the drain of $16^{th}$ MOS transistor (M16), the gates of the $20^{th}$ and $21^{st}$ MOS transistors (M20, M21), and the source of the $19^{th}$ MOS transistor (M19), the power supply terminal (VSS) is connected to the second intermediate connection node (N2) commonly connected the sources of the $15^{th}$ and $17^{th}$ MOS transistors (M15, M17), and the drains of the $18^{th}$ and $20^{th}$ MOS transistors (M18, M20), the source of the $14^{th}$ MOS transistor (M14) and the drain of the $15^{th}$ MOS transistor (M15) are connected each other, the source of the $16^{th}$ MOS transistor (M16) and the drain of the $17^{th}$ MOS transistor (M17) are connected each other, the source of the $18^{th}$ MOS transistor (M18) and the drain of the $19^{th}$ MOS transistor (M19) are connected each other, and the source of the $20^{th}$ MOS transistor (M20) and the drain of the $21^{st}$ MOS transistor (M21) are connected each other.

10. The driving circuit of claim 9, wherein the positive and negative polarity output nodes (Q-Node, $\overline{Q}$-Node) sequentially transition in the order of 10V, −8V and −26V in synchronization with the first to third gate output voltages (VGOUT1, VGOUT2, VGOUT3).

11. The driving circuit of claim 1, wherein, in the common voltage output unit, the positive polarity output nodes (Q-Node) is the gate of the $22^{nd}$ MOS transistor (M22), the negative polarity output nodes ($\overline{Q}$-Node) is connected to the gate of the $23^{rd}$ MOS transistor (M23), the fifth condenser (C5) is connected between the gates of the $22^{nd}$ and $23^{rd}$ MOS transistors (M22, M23), a terminal of the higher common voltage (VCOMH) is the source of the $22^{nd}$ MOS transistors (M22), a terminal of the lower common voltage (VCOML) is the source of the $23^{rd}$ MOS transistors (M23), and the drains of the $22^{nd}$ and $23^{rd}$ MOS transistors (M22, M23) are commonly connected to the common voltage output terminal (VCOMOUT).

12. The driving circuit of claim 11, wherein the higher common voltage (VCOMH) is 5V.

13. The driving circuit of claim 11, wherein the lower common voltage (VCOML) is 0V.

14. The driving circuit of claim 11, wherein the fifth condenser (C5) prevents a gate voltage of the $22^{nd}$ MOS transistor (M22) from being changed when a higher common voltage (VCOMH) is output via the $22^{nd}$ MOS transistor (M22).

15. The driving circuit of claim 11, wherein the fifth condenser (C5) prevents a gate voltage of the $23^{rd}$ MOS transistor (M23) from being changed when a lower common voltage (VCOML) is output via the $23^{rd}$ MOS transistor (M23).

16. The driving circuit of claim 11, wherein the $22^{nd}$ and $23^{rd}$ MOS transistors (M22, M23) are alternately turned on by the voltages of positive and negative polarity output nodes (Q-Node, $\overline{Q}$-Node).

17. The driving circuit of claim 11, wherein the fifth condenser (C5) has a capacity of 0.1 PF or greater.

18. The driving circuit of claim 1, wherein the LCD comprises a liquid crystal panel with a common voltage driving circuit installed therein.

* * * * *